United States Patent [19]

Gannaway

[11] Patent Number: 4,969,804

[45] Date of Patent: Nov. 13, 1990

[54] SUCTION LINE CONNECTOR FOR HERMETIC COMPRESSOR

[75] Inventor: Edwin L. Gannaway, Adrian, Mich.

[73] Assignee: Tecumseh Products Company, Tecumseh, Mich.

[21] Appl. No.: 320,568

[22] Filed: Mar. 8, 1989

[51] Int. Cl.[5] ..... F04B 39/14

[52] U.S. Cl. ..... 417/360; 417/902

[58] Field of Search ..... 417/312, 313, 360, 363, 417/902

[56] References Cited

U.S. PATENT DOCUMENTS

| | | | |
|---|---|---|---|
| 2,243,466 | 5/1941 | Kucher . | |
| 3,031,861 | 5/1962 | McCormack . | |
| 4,086,032 | 4/1978 | Nishioka et al. . | |
| 4,141,223 | 2/1979 | Dyhr et al. . | |
| 4,160,625 | 7/1979 | Dyhr et al. . | |
| 4,242,056 | 12/1980 | Dyhr et al. . | |
| 4,334,835 | 6/1982 | Dyhr et al. . | |
| 4,518,324 | 5/1985 | Mizuno et al. | 417/902 X |
| 4,623,304 | 11/1986 | Chikada et al. | 417/902 X |
| 4,639,198 | 1/1987 | Gannaway . | |
| 4,676,075 | 6/1987 | Shiibayashi . | |
| 4,730,695 | 3/1988 | Bar | 417/312 X |
| 4,929,157 | 5/1990 | Steele et al. | 417/312 |

*Primary Examiner*—Leonard E. Smith
*Assistant Examiner*—Eugene L. Szczecina, Jr.
*Attorney, Agent, or Firm*—Jeffers, Hoffman & Niewyk

[57] ABSTRACT

A compressor assembly including a compressor mechanism mounted within a hermetically sealed housing. The compressor mechanism includes a crankcase having a suction inlet opening providing communication into a suction cavity within the crankcase. A suction line adaptor is provided for attaching to a suction line of a refrigeration system to introduce suction gas from the exterior of the housing to the suction inlet opening within. The suction line connector includes a fitting mounted to the housing sidewall and having a bore communicating therethrough, and a tube insert extending between the fitting and the suction inlet opening. The tube insert includes annular protuberances at opposite ends thereof, each protuberance having a groove into which an O-ring seal is retained. The opposite ends of the tube insert are sealingly received within the fitting bore and the suction inlet opening, respectively, whereby limited axial, radial, and torsional movement of the compressor mechanism relative to the housing is permitted while maintaining the integrity of the suction tube connector against leakage from the interior of the housing.

22 Claims, 3 Drawing Sheets

SUCTION LINE CONNECTOR FOR HERMETIC COMPRESSOR

BACKGROUND OF THE INVENTION

The present invention relates generally to a hermetic compressor assembly and, more particularly, to a direct suction compressor assembly having a crankcase mounted within a sealed housing, wherein suction gas is delivered directly to the crankcase from a suction line outside the housing by means of a suction line connector.

In general, prior art hermetic compressor assemblies comprise a hermetically sealed housing having a compressor mechanism mounted therein. The compressor mechanism may include a crankcase or a cylinder block defining a compression chamber therein in which gaseous refrigerant is compressed and subsequently discharged. Typically, and especially in the case of a compressor assembly having a pressurized housing, suction gas returning from a refrigeration system is provided to the compression chamber by means of a conduit extending from outside the housing to the compression chamber within the crankcase. This configuration is commonly referred to as a direct suction compressor assembly. In such a compressor assembly, it is known to introduce suction tubing through the housing and into a suction inlet opening in the crankcase or cylinder block that is in communication with the compression chamber. The portion of the tubing external of the housing may comprise part of a suction accumulator or may constitute a fitting to which a suction line of a refrigeration system may be attached.

In the aforementioned compressor assembly wherein a suction tube leads from an inlet opening in the crankcase through a hole in the housing, two basic problems arise. During assembly, misalignment of the crankcase with respect to the housing may cause the suction tubing to be overstressed. Specifically, manufacturing tolerances for component parts of the compressor assembly, i.e., parts having apertures and openings through which the suction tube extends, may lead to difficulty in assembling the compressor and result in unwanted stress on the suction tubing once the compressor is assembled. Stress on the suction tubing in contact with the housing produces unwanted noise during compressor operation.

A second problem associated with the above-characterized compressor assembly occurs during compressor operation, and relates to the transmission of vibration and noise from the compressor to the housing by means of the suction tubing linkage therebetween. Specifically, the compressor mechanism may undergo slight excursions in response to axial, radial, and torsional forces acting thereupon during compressor operation. Consequently, the nature of the linkage between the compressor mechanism and the stationary housing determines the extent to which vibration and noise are imparted to the housing. The suction connector must also withstand such forces and maintain integrity against leakage from the interior of the housing.

The problems discussed herein have been addressed to some extent by several prior art devices. For instance, a suction line connector is known which comprises a pair of L-fittings respectively attached to the housing and the crankcase at axially spaced locations thereon, and a connecting pipe inside the low pressure housing between the pair of L-fittings disposed axially perpendicular to and intermediate the housing and the crankcase. The connecting pipe is capable of moving relative to one or both of the L-fittings to compensate for variations in radial and axial spacing between the housing and the crankcase. A problem with such a suction tube connector is that space is required between the crankcase and the housing sidewall within the housing. Furthermore, the connector is difficult to assemble and is not suitable for a compressor having a pressurized, or high side, housing.

Another common prior art approach to compensating for radial spacing between the housing and the inlet aperture in the compressor crankcase is the provision of an 0-ring seal within the inlet opening to allow a suction tube end to variably penetrate into the aperture. Typically in this approach, an adapter at the housing aperture is welded to the housing and brazed to the tubing. A primary problem of this arrangement is that it provides for only one degree of freedom for movement of the compressor during operation.

A further prior art suction tube connector directed to compensating for spacing variations between the housing and the compressor crankcase comprises a tube entering radially inwardly from the housing sidewall and having a slotted conical flange at the end thereof to abut against the crankcase in the general area of the suction inlet aperture. The divergent end of the conical flange has a diameter greater than the suction inlet aperture, thereby permitting alignment variations.

With respect to suction line connectors for use in an indirect suction hermetically sealed compressor assembly, i.e., where the suction gas enters into the interior space of the housing, a suction line adapter device is known which is attached to the housing as by welding. This adapter comprises two pieces, one of which is welded to the housing at the location of the aperture therethrough, and the other being a coupling member attachable to a refrigeration system suction line as by brazing or the like. The coupling member with suction line attached thereto is then screwed onto the fitting welded to the housing for sealing engagement therewith. A nut threadedly engages each of the two components and brings them forcibly together at a surface to surface juncture having an 0-ring seal seated therebetween.

SUMMARY OF THE INVENTION

The present invention overcomes the disadvantages of the above-described prior art suction line connectors by providing an improved connector for a direct suction hermetic compressor assembly, wherein limited axial, radial, and torsional movement of the compressor mechanism relative to the housing is permitted, and the integrity of the suction line connector against leakage from the interior of the housing and transmission of vibration and noise to the housing is maintained.

In general, the present invention provides a suction line connector in a direct suction hermetic compressor assembly comprising a housing in which is disposed a compressor mechanism that undergoes limited axial, radial, and torsional movement. The suction line connector includes a conduit that extends through a discharge pressure space within the housing, between a suction inlet opening in a crankcase of the compressor mechanism and a suction fitting mounted in the sidewall of the housing. The opposite ends of the conduit are sealingly engaged within the suction inlet opening and the suction fitting, respectively, in a manner to permit axial and angular movement of the conduit relative to each of the suction inlet opening and suction fitting in response to limited movement of the compressor mechanism relative to the housing.

More specifically, the invention provided, in one form thereof, a suction line connector for a hermetic compressor assembly wherein a fitting is mounted in the sidewall of the housing defining a bore generally axially aligned with a suction inlet opening in the crankcase of a compressor mechanism supported within the housing. A suction conduit having an annular protuberance at each of its end portions is sealingly received at one end thereof within the suction inlet opening and extends radially outwardly to be sealingly received into the bore defined by the fitting. Each protuberance of the conduit may have an annular seal groove formed therein into which is received an annular seal element, which is thereby sealingly disposed intermediate the conduit and the fitting and suction inlet opening, respectively.

An advantage of the suction line connector of the present invention is that a sealed suction line connection between a fitting in the housing sidewall and a suction opening in the crankcase is provided despite limited axial, radial, and torsional movement of the compressor mechanism relative to the housing.

Another advantage of the suction line connector of the present invention is that compensation for tolerances associated with housing and crankcase machining, and assembly tolerances between such parts, is provided.

A further advantage of the suction line connector of the present invention is that the suction conduit associated therewith is easily introduced and removed through the suction fitting on the housing, thereby simplifying compressor assembly.

Yet another advantage of the suction line connector of the present invention is that refrigerant at suction pressure is conveyed from the housing fitting to the crankcase through a discharge pressure space, without leakage and movement of the suction conduit caused by pressure differentials.

A still further advantage of the suction line connector of the present invention is that an easily removable conical screen filter is provided in combination with a suction line fitting.

Another advantage of the suction line connector of the present invention is that noise transmission from the crankcase to the housing by means of the suction inlet connector is substantially eliminated.

The compressor assembly of the present invention, in one form thereof, provides a hermetically sealed housing including a sidewall and having a discharge pressure chamber therein. Supported within the housing is a compressor mechanism for compressing refrigerant, which includes a crankcase having a suction cavity disposed therein and a suction inlet bore providing communication between the suction cavity and the outside of the crankcase. The suction inlet bore extends radially outwardly from the cavity along an axis substantially perpendicular to the sidewall. A suction fitting is mounted in the sidewall and includes a fitting bore extending therethrough along an axis substantially perpendicular to the sidewall. The fitting bore and the suction inlet bore are generally aligned. The present invention further provides a suction conduit having a first axial end portion received within the fitting bore, a second axial end portion received within the suction inlet bore, and an intermediate portion extending through the discharge pressure chamber. A first seal is disposed intermediate the first end portion and the fitting bore, and a second seal is disposed intermediate the second end portion and the suction inlet bore. The first and second seals sealingly engage the conduit within the fitting bore and the suction inlet bore, respectively. In this manner, the suction conduit is sealed from the discharge pressure chamber. In one aspect of this form of the invention, each of the first and second end portions of the suction conduit has an annular protuberance in which is formed an annular seal groove that receives a respective annular seal.

There is further provided, in one form of the invention, a compressor assembly including a hermetically sealed housing having a sidewall. Supported within the housing is a compressor mechanism comprising a crankcase having a suction cavity disposed therein and a suction inlet bore to provide communication between the suction cavity and the outside of the crankcase. The suction inlet bore extends radially outwardly from the cavity along an axis substantially perpendicular to the sidewall. A suction fitting is mounted in the sidewall and includes a fitting bore which extends therethrough along an axis substantially perpendicular to the sidewall. The fitting bore and the suction inlet bore are generally aligned. The invention further includes a suction conduit having a first axial end portion received within the fitting bore and a second axial end portion received within the suction inlet bore. The first axial end portion is sealingly engaged within the fitting bore and the second axial end portion is sealingly engaged within the suction inlet bore in a manner to permit axial and angular movement of the first axial end portion and the second axial end portion relative to the axes of the fitting bore and the suction inlet bore, respectively, in response to limited movement of the compressor mechanism relative to the housing. In one aspect of the invention of this form, the suction conduit is capable of limited axial movement generally along the axes of the fitting bore and the suction inlet bore, wherein radially inward axial movement of the suction conduit is limited by the crankcase, and radially outward axial movement of the suction conduit is limited by the outer fitting member. In another aspect of the invention of this form, the suction conduit is generally cylindrical and has a diameter less than that of the fitting bore. In this manner, the suction conduit is capable of being introduced and removed through the suction fitting.

DESCRIPTION OF THE PREFERRED EMBODIMENT

Figure 1:
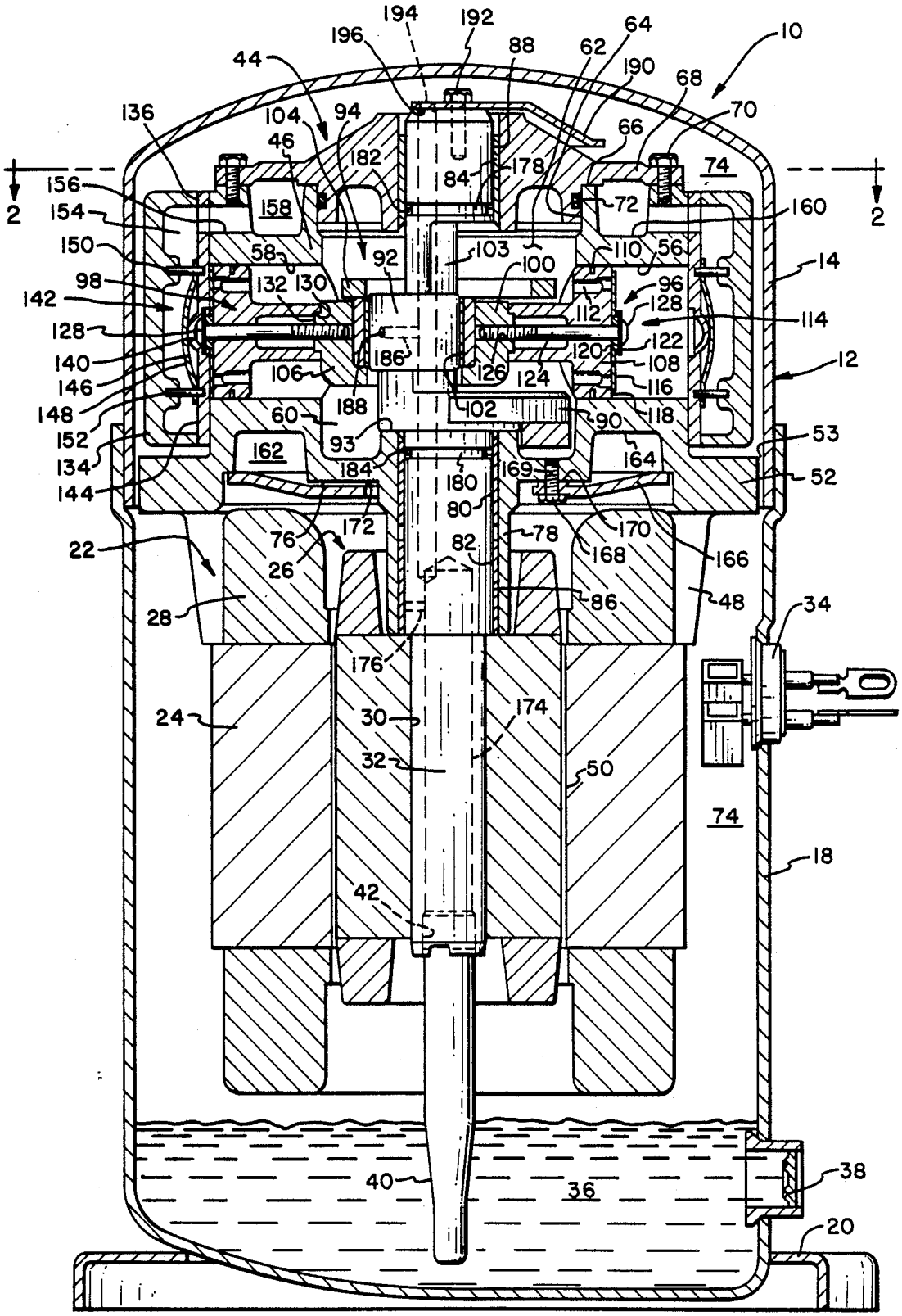
FIG. 1 is a side sectional view of a compressor of the type to which the present invention pertains, taken along the line 1—1 in FIG. 2 and viewed in the direction of the arrows.

In an exemplary embodiment of the invention as shown in the drawings, and in particular by referring to FIG. 1, a compressor assembly 10 is shown having a housing generally designated at 12. The housing has a top portion 14 and a bottom portion 18. The two housing portions are hermetically secured together as by welding or brazing. A mounting flange 20 is welded to the bottom portion 18 for mounting the compressor in a vertically upright position. Located within hermetically sealed housing 12 is an electric motor generally designated at 22 having a stator 24 and a rotor 26. The stator is provided with windings 28. Rotor 26 has a central aperture 30 provided therein into which is secured a crankshaft 32 by an interference fit. A terminal cluster 34 is provided in bottom portion 18 of housing 12 for connecting the compressor to a source of electric power. Where electric motor 22 is a three-phase motor, bidirectional operation of compressor assembly 10 is achieved by changing the connection of power at terminal cluster 34.

Compressor assembly 10 also includes an oil sump 36 located in bottom portion 18. An oil sight glass 38 is provided in the sidewall of bottom portion 18 to permit viewing of the oil level in sump 36. A centrifugal oil pick-up tube 40 is press fit into a counterbore 42 in the end of crankshaft 32. Oil pick-up tube 40 is of conventional construction and includes a vertical paddle (not shown) enclosed therein.

Figure 2:
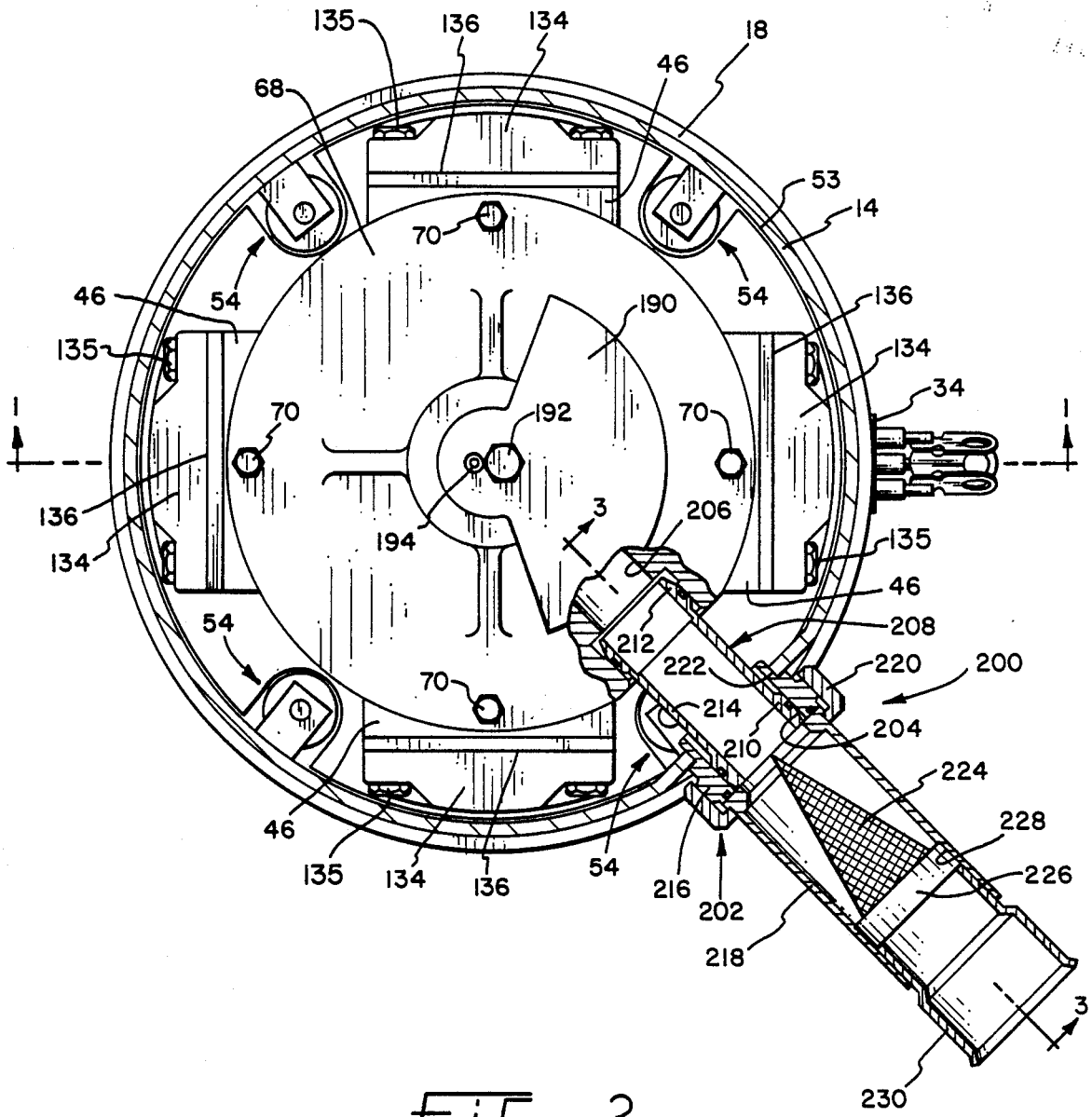
FIG. 2 is a top view of the compressor mechanism within the housing of the compressor of FIG. 1, showing a sectional view of the housing taken along line 2—2 in FIG. 1 and viewed in the direction of the arrows, a portion of the compressor mechanism being cut away to show the engagement of the suction tube insert within the suction inlet opening of the crankcase.
Figure 3:
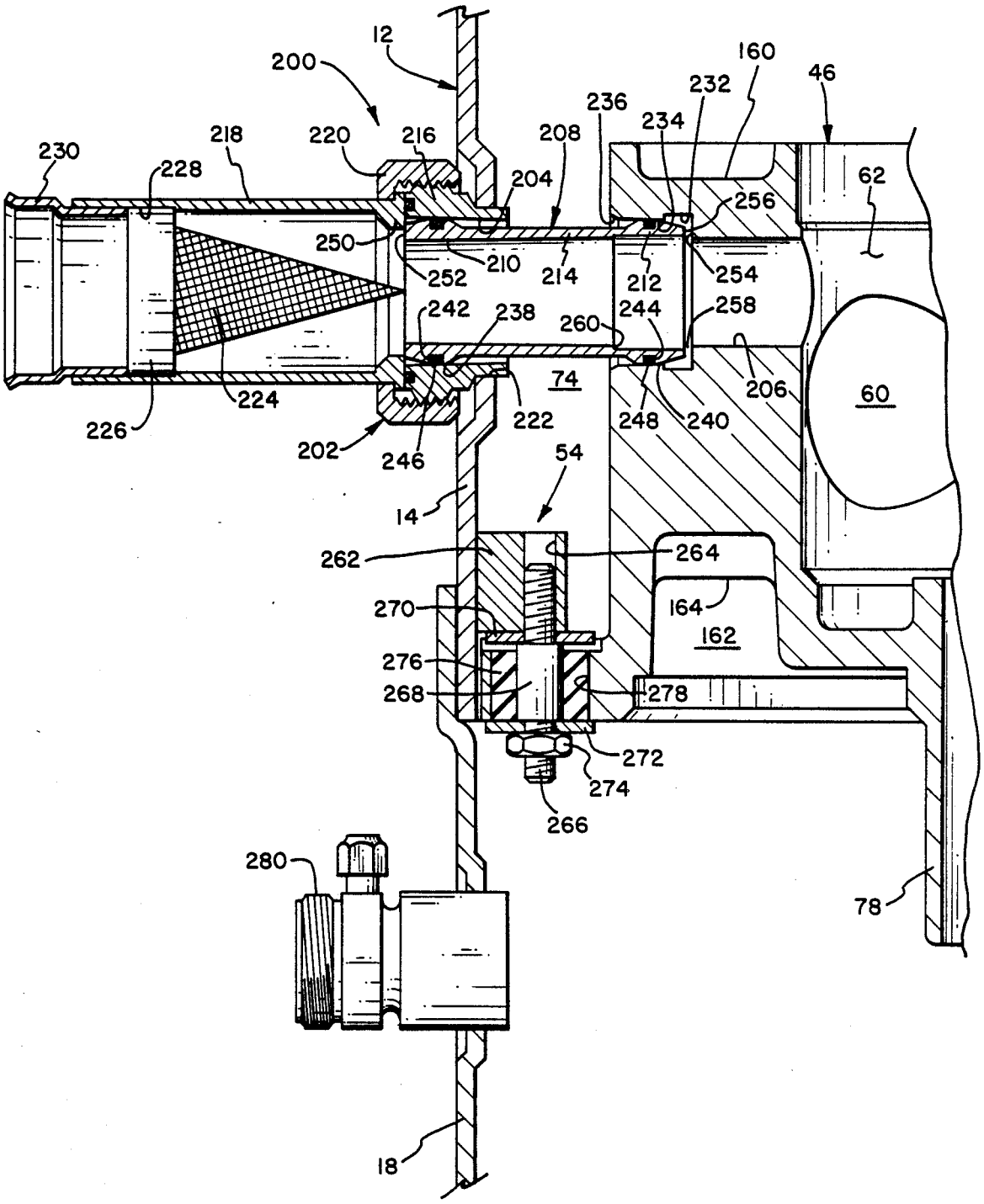
FIG. 3 is a fragmentary sectional view of the crankcase and housing assembly of FIG. 3 taken along the line 4—4 in FIG. 3 and viewed in the direction of the arrows, particularly showing a suction line connector in accordance with the present invention.

Also enclosed within housing 12, in the embodiment of FIG. 1, is a compressor mechanism generally designated at 44. Compressor mechanism 44 comprises a crankcase 46 including a plurality of mounting lugs 48 to which motor stator 24 is attached such that there is an annular air gap 50 between stator 24 and rotor 26. Crankcase 46 also includes a circumferential mounting flange 52 supported within housing 12 by means of a plurality of resilient mounting assemblies 54, as shown in FIGS. 2 and 3. An annular space 53, intermediate the peripheral edge of flange 52 and housing top portion 14, provides communication between the top and bottom ends of housing 12 for return of lubricating oil and equalization of discharge pressure within the entire housing interior.

Compressor mechanism 44, as illustrated in the preferred embodiment, takes the form of a reciprocating piston, scotch yoke compressor. More specifically, crankcase 46 includes four radially disposed cylinders, two of which are shown in FIG. 1 and designated as cylinder 56 and cylinder 58. The four radially disposed cylinders open into and communicate with a central suction cavity 60 defined by inside cylindrical wall 62 in crankcase 46. A relatively large pilot hole 64 is provided in a top surface 66 of crankcase 46. Various compressor components, including the crankshaft, are assembled through pilot hole 64. A top cover such as cage bearing 68 is mounted to the top surface of crankcase 46 by means of a plurality of bolts 70 extending through bearing 68 into top surface 66. When bearing 68 is assembled to crankcase 46, an 0-ring seal 72 isolates suction cavity 60 from a discharge pressure space 74 defined by the interior of housing 12.

Crankcase 46 further includes a bottom surface 76 and a bearing portion 78 extending therefrom. Retained within bearing portion 78, as by press fitting, is a sleeve bearing assembly comprising a pair of sleeve bearings 80 and 82. Two sleeve bearings are preferred rather than a single longer sleeve bearing to facilitate easy assembly into bearing portion 78. Likewise, a sleeve bearing 84 is provided in cage bearing 68, whereby sleeve bearings 80, 82, and 84 are in axial alignment. Sleeve bearings 80, 82, and 84 are manufactured from steel-backed bronze.

Referring once again to crankshaft 32, there is provided thereon journal portions 86 and 88, wherein journal portion 86 is received within sleeve bearings 80 and 82, and journal portion 88 is received within sleeve bearing 84. Accordingly, crankshaft 32 is rotatably journalled in crankcase 46 and extends through a suction cavity 60. Crankshaft 32 includes a counterweight portion 90 and an eccentric portion 92 located opposite one another with respect to the central axis of rotation of crankshaft 32 to thereby counterbalance one another. The weight of crankshaft 32 and rotor 26 is supported on thrust surface 93 of crankcase 46.

Eccentric portion 92 is operably coupled by means of a scotch yoke mechanism 94 to a plurality of reciprocating piston assemblies corresponding to, and operably disposed within, the four radially disposed cylinders in crankcase 46. As illustrated in FIG. 1, piston assemblies 96 and 98, representative of four radially disposed piston assemblies operable in compressor assembly 10, are associated with cylinders 56 and 58, respectively.

Scotch yoke mechanism 94 comprises a slide block 100 including a cylindrical bore 102 in which eccentric portion 92 is journalled. In the preferred embodiment, cylindrical bore 102 is defined by a steel backed bronze sleeve bearing press fit within slide block 100. A reduced diameter portion 103 in crankshaft 32 permits easy assembly of slide block 100 onto eccentric portion 92. Scotch yoke mechanism 94 also includes a pair of yoke members 104 and 106 which cooperate with slide block 100 to convert orbiting motion of eccentric portion 92 to reciprocating movement of the four radially disposed piston assemblies. For instance, FIG. 1 shows yoke member 106 coupled to piston assemblies 96 and 98, whereby when piston assembly 96 is at a bottom dead center (BDC) position, piston assembly 98 will be at a top dead center (TDC) position.

Referring once again to piston assemblies 96 and 98, each piston assembly comprises a piston member 108 having an annular piston ring 110 to allow piston member 108 to reciprocate within a cylinder to compress gaseous refrigerant therein. Suction ports 112 extending through piston member 108 allow suction gas within suction cavity 60 to enter cylinder 56 on the compression side of piston 108.

A suction valve assembly 114 is also associated with each piston assembly, and will now be described with respect to piston assembly 96 shown in FIG. 1. Suction valve assembly 114 comprises a flat, disk-shaped suction valve 116 which in its closed position covers suction ports 112 on a top surface 118 of piston member 108. Suction valve 116 opens and closes by virtue of its own inertia as piston assembly 96 reciprocates in cylinder 56. More specifically, suction valve 116 rides along a cylindrical guide member 120 and is limited in its travel to an open position by an annular valve retainer 122.

As illustrated in FIG. 1, valve retainer 122, suction valve 116, and guide member 120 are secured to top surface 118 of piston member 108 by a threaded bolt 124 having a buttonhead 128. Threaded bolt 124 is received within a threaded hole 126 in yoke member 106 to secure piston assembly 96 thereto. As shown with respect to the attachment of piston assembly 98 to yoke member 106, an annular recess 130 is provided in each piston member and a complementary boss 132 is provided on the corresponding yoke member, whereby boss 132 is received within recess 130 to promote positive, aligned engagement therebetween.

Compressed gas refrigerant within each cylinder is discharged through discharge ports in a valve plate. With reference to cylinder 58 in FIG. 1, a cylinder head cover 134 is mounted to crankcase 46 with a valve plate 136 interposed therebetween. A valve plate gasket is provided between valve plate 136 and crankcase 46. Valve plate 136 includes a coined recess 140 into which buttonhead 128 of threaded bolt 124 is received when piston assembly 98 is positioned at top dead center (TDC).

A discharge valve assembly 142 is situated on a top surface 144 of valve plate 136. Generally, compressed gas is discharged through valve plate 136 past an open discharge valve 146 that is limited in its travel by a discharge valve retainer 148. Guide pins 150 and 152 extend between valve plate 136 and cylinder head cover 134, and guidingly engage holes in discharge valve 146 and discharge valve retainer 148 at diametrically opposed locations therein. Valve retainer 148 is biased against cylinder head cover 134 to normally retain discharge valve 146 against top surface 144 at the diametrically opposed locations. However, excessively high mass flow rates of discharge gas or hydraulic pressures caused by slugging may cause valve 146 and retainer 148 to be guidedly lifted away from top surface 144 along guide pins 150 and 152.

Referring once again to cylinder head cover 134, a discharge space 154 is defined by the space between top surface 144 of valve plate 136 and the underside of cylinder head cover 134. Cover 134 is mounted about its perimeter to crankcase 46 by a plurality of bolts 135, shown in FIG. 2. Discharge gas within discharge space 154 associated with each respective cylinder passes through a respective connecting passage 156, thereby providing communication between discharge space 154 and a top annular muffling chamber 158. Chamber 158 is defined by an annular channel 160 formed in top surface 66 of crankcase 46, and cage bearing 68. As illustrated, connecting passage 156 passes not only through crankcase 46, but also through holes in valve plate 136 and the valve plate gasket.

Top muffling chamber 158 communicates with a bottom muffling chamber 162 by means of passageways extending through crankcase 46. Chamber 162 is defined by an annular channel 164 and a muffler cover plate 166. Cover plate 166 is mounted against bottom surface 76 at a plurality of circumferentially spaced locations by bolts 168 and threaded holes 169. Bolts 168 may also take the form of large rivets or the like. A plurality of spacers 170, each associated with a respective bolt 168, space cover plate 166 from bottom surface 76 at the radially inward extreme of cover plate 166 to form an annular exhaust port 172. The radially outward extreme portion of cover plate 166 is biased in engagement with bottom surface 76 to prevent escape of discharge gas from within bottom muffling chamber 162 at this radially outward location.

Compressor assembly 10 of FIG. 1 also includes a lubrication system associated with oil pick-up tube 40 previously described. Oil pick-up tube 40 acts as an oil pump to pump lubricating oil from sump 36 upwardly through an axial oil passageway 174 extending through crankshaft 32. An optional radial oil passageway 176 communicating with passageway 174 may be provided to initially supply oil to sleeve bearing 82. The disclosed lubrication system also includes annular grooves 178 and 180 formed in crankshaft 32 at locations along the crankshaft adjacent opposite ends of suction cavity 60 within sleeve bearings 80 and 84. Oil is delivered into annular grooves 178, 180 behind annular seals 182, 184, respectively retained therein. Seals 182, 184 prevent high pressure gas within discharge pressure space 74 in the housing from entering suction cavity 60 past sleeve bearings 84 and 80, 82, respectively. Also, oil delivered to annular grooves 178, 180 behind seals 182 and 184 lubricate the seals as well as the sleeve bearings.

Another feature of the disclosed lubrication system of compressor assembly 10 in FIG. 1, is the provision of a pair of radially extending oil ducts 186 from axial oil passageway 174 to a corresponding pair of openings 188 on the outer cylindrical surface of eccentric portion 92.

A counterweight 190 is attached to the top of shaft 32 by means of an off-center mounting bolt 192. An extruded hole 194 through counterweight 190 aligns with axial oil passageway 174, which opens on the top of crankshaft 32 to provide an outlet for oil pumped from sump 36. An extruded portion 196 of counterweight 190 extends slightly into passageway 174 which, together with bolt 192, properly aligns counterweight 190 with respect to eccentric portion 92.

Referring now to FIGS. 2 and 3, there is shown a suction line connector assembly 200 in accord with the present invention, whereby refrigerant at suction pressure is supplied from a refrigeration system (not shown) external of housing 12, through discharge pressure space 74 within the housing, into suction cavity 60 within crankcase 46. Generally, connector assembly 200 comprises a housing fitting assembly 202 having a fitting bore 204 extending therethrough, a suction inlet bore 206 formed in crankcase 46 that communicates with suction cavity 60, and a suction conduit 208. Suction conduit 208 has a first axial end 210 received within fitting bore 204, a second axial end 212 received within suction inlet bore 206, and an intermediate portion 214 extending through discharge pressure space 74.

Housing fitting assembly 202 comprises a housing fitting member 216, a removable outer fitting member 218, and a threaded nut 220 that is rotatable yet axially retained on outer fitting member 218. Housing fitting member 216 is received within an aperture 222 in top portion 14 of the housing, and is sealingly attached thereto as by welding, brazing, soldering, or the like. Outer member 218 incorporates a conical screen filter 224 having a mounting ring 226 at the base end thereof that is slip fit into a counterbore 228 provided in the outer end of outer member 218. In such an arrangement, filter 224 may be easily removed for cleaning or replacement. Filter 224 is retained within counterbore 228 by means of a copper fitting 230 that is soldered or brazed to the suction tubing of a refrigeration system (not shown). In turn, copper fitting 230 is received within counterbore 228 and is soldered or brazed to outer member 218. Housing fitting assembly 202 is a slightly modified version of a fitting that is commercially available from Primor of Adrian, MI.

Suction line connector assembly 200 of the preferred embodiment will now be more particularly described with reference to FIG. 3. Suction inlet bore 206 extends radially outwardly from suction cavity 60 along an axis substantially perpendicular to the housing sidewall.

Likewise, fitting bore 204 extends through the housing sidewall along an axis perpendicular thereto. Upon assembly of compressor 10 of the preferred embodiment, it is intended that the axes of suction inlet bore 206 and fitting bore 204 be substantially aligned. However, due to machining and assembly tolerances, and dynamic forces acting on the compressor mechanism during operation, the bores may not be initially aligned nor remain so during compressor operation. Therefore, as described hereinafter, means are provided for sealingly engaging first end portion 210 within fitting bore 204 and second end portion 212 within suction inlet bore 206, in a manner to permit axial and angular movement of first end portion 210 and second end portion 212 relative to fitting bore 204 and suction inlet bore 206, respectively, in response to limited movement of compressor mechanism 44 relative to housing 12.

Suction inlet bore 206 includes an annular relief 232 for the purpose of permitting a honing or burnishing tool to bearingize a cylindrical sealing surface 234, which constitutes the radially outermost portion of suction inlet bore 206. Likewise, fitting bore is polished, or bearingized, to provide a smooth cylindrical sealing surface. A chamfer 236 is provided at the opening of suction inlet bore 206 to facilitate insertion of first end portion 210 of suction conduit 208.

Suction conduit 208, according to the disclosed preferred embodiment of the invention, comprises a short length of spun or swedged cylindrical tubing, wherein first end portion 210 is formed with an annular protuberance 238 and second end portion 212 is formed with a corresponding annular protuberance 240. Annular protuberances 238 and 240 are essentially at locations on suction conduit 208 where the diameter is greater than axially adjacent portions. More specifically, protuberances 238 and 240 of the preferred embodiment slope away from a central point of maximum diameter toward decreasing conduit diameter, thereby permitting each end of the suction conduit to pivot within its associated bore. The amount of pivoting is limited by the geometry of the protuberance and the axial penetration of the conduit within the bore.

Although it is conceivable that a rounded, well-polished protuberance could provide sealing engagement of a conduit end portion within a bore, protuberances 238 and 240 are formed with annular seal grooves 242 and 244, into which 0-ring seals 246 and 248 are received, respectively. The cross-sectional diameter of each 0-ring seal is greater than the depth of its respective groove and, therefore, the seal extends above the surface of the protuberance at its maximum diameter and sealingly contacts the cylindrical sealing surface of its associated bore. In the preferred embodiment, 0-ring seals 246 and 248 are composed of a rubber material, such as neoprene or viton, and have a cross-sectional diameter of approximately 0.0070 inches. The annular clearance between each protuberance and its associated bore is approximately 0.005 inches, while the depth of each seal groove is approximately 0.050–0.055 inches. Therefore, the 0-ring seals are under approximately 0.010–0.015 inches compression when installed.

Furthermore, the axial dimension of grooves 242 and 244 is approximately twice the diameter of the 0-ring seal, thereby permitting 0-ring seals 246 and 248 to move axially outwardly within seal grooves 242 and 244, respectively, in response to the pressure differential between discharge pressure space 74 and the opposite side of the protuberance exposed to the refrigerant at suction pressure being transported through suction conduit 208. Because each end of suction conduit 208 is subjected to opposing forces generated by the same pressure differential, there is no net axial force acting on the conduit.

When assembling suction line connector assembly 200 of the present invention, outer fitting member 218, including threaded nut 220, is first removed. Suction conduit 208, with 0-ring seals 246 and 248 installed, is then inserted through fitting bore 204 until first end portion 210 is sealingly received within fitting bore 204 and second end portion 212 is sealingly received within cylindrical sealing surface 236 of suction inlet bore 206. Outer fitting member 218 is then installed so that suction conduit 208 is axially restrained. Specifically, a narrowing 250 of fitting member 218 provides an axial stop for conduit distal end surface 252. Likewise, step 254 in suction inlet bore 206 provides an axial stop for conduit proximal end surface 256. An axial space 258, which may be divided between either conduit end surface and its respective stop, permits limited radial movement of compressor mechanism 44 with respect to housing 12. Removal of suction conduit 208 through fitting bore 204 is facilitated by the provision of a step 260 formed by a counterbore made in second end portion 212. An expanding tool may be introduced through the conduit opening adjacent first end portion 210, and then engaged with step 260 for easy retraction of the conduit.

Referring once again to mounting assemblies 54, it is necessary that these mounting assemblies limit the displacement of compressor mechanism 44 relative to housing 12, to prevent damage to suction conduit 208 and 0-ring seals 246 and 248. In the embodiment of mounting assembly 54 shown in FIG. 3, a steel mounting block 262 is welded to the inside wall of housing top portion 14. Mounting block 262 includes an axially oriented threaded hole 264. Mounting flange 52 of crankcase 46 is suspended from mounting block 262 by means of an assembly comprising a threaded stud 266, a spacer 268, a pair of washers 270 and 272, a retaining nut 274, and a ring-shaped rubber grommet 276.

More specifically, threaded stud 266 is received into threaded hole 264 so as to extend downwardly therefrom. As shown in FIG. 3, spacer 268 is flanked by washers 270 and 272, and the three are held on stud 266 by retaining nut 274. Spacer 268 may optionally be an integral part of stud 266, whereby washer 270 would be retained intermediate block 262 and spacer 268 by threading stud 266 into hole 264. Grommet 276 surrounds spacer 268 and, in turn, fills bore 278 provided in mounting flange 52 of crankcase 46. The diameter of washers 270 and 272 is greater than that of bore 278, whereby mounting assembly 54 limits axial movement of compressor mechanism 44, e.g., during shipping. Lateral displacement of the compressor mechanism during operation is resiliently restrained by the transmission of forces from mounting flange 52 to housing 12, through grommet 276.

It will be appreciated that transmission of noise from compressor mechanism 44 to housing 12 is minimized not only by grommet 276, but also by the small annular contacting area between mounting flange 52 and bottom washer 272. This contacting area is minimized by the sizing of washer 272 and bore 278 to insure continuous annular contact for the expected maximum lateral displacement of the compressor mechanism relative to the housing. In one embodiment, the diameter of washer 272 is approximately 0.090 inches greater than that of bore 278. It is also appreciated that grommet 276, when made of neoprene, may initially have a diameter approximately 0.020–0.030 inches less than bore 278. However, upon exposure of the grommet to the operating environment within housing 12, the grommet swells to fill bore 278.

FIG. 3 also shows a discharge fitting 280 provided in bottom portion 18 of housing 12 located directly beneath suction line connector assembly 200. The location of discharge fitting 280 in a central or lower portion of the housing provides an advantage in that the fitting acts as a dam and limits to about 20 lbs. the amount of refrigerant charge that will be retained by the compressor and required to be pumped out upon startup.

It will be appreciated that the foregoing is presented by way of illustration only, and not by way of any limitation, and that various alternatives and modifications may be made to the illustrated embodiment without departing from the spirit and scope of the invention.

What is claimed is:

1. A compressor assembly, comprising:

a hermetically sealed housing including a sidewall and having a discharge pressure chamber therein;

means supported within said housing for compressing refrigerant, including a compressor mechanism having a crankcase, said crankcase having a suction cavity disposed therein and a suction inlet bore providing communication between said suction cavity and the outside of said crankcase, said suction inlet bore extending radially outwardly from said suction cavity along an axis substantially perpendicular to said sidewall;

a suction fitting mounted in said sidewall, said fitting, including a fitting bore extending therethrough along an axis substantially perpendicular to said sidewall, said fitting bore and said suction inlet bore being generally aligned;

a suction conduit having a first axial end portion received within said fitting bore, a second axial end portion received within said suction inlet bore, and an intermediate portion extending through said discharge pressure chamber; and first seal means disposed radially intermediate said first end portion and said fitting bore, and second seal means disposed radially intermediate said second end portion and said suction inlet bore, for sealingly engaging said conduit within said fitting bore and said suction inlet bore, respectively, wherein a first annular space is defined radially intermediate said first end portion and said fitting bore and axially adjacent said first seal means, and a second annular space is defined radially intermediate said second end portion and said suction inlet bore and axially adjacent said second seal means, whereby said suction conduit is sealed from said discharge pressure chamber and limited movement of said compressor mechanism relative to said housing is permitted.

2. The compressor assembly of claim 1 in which:

said first seal means comprises a first annular protuberance on said suction conduit, having greater diameter than axially adjacent portions of said suction conduit; and said second seal means comprises a second annular protuberance on said suction conduit, having greater diameter than axially adjacent portions of said suction conduit.

3. The compressor assembly of claim 2 in which:

said first seal means comprises a first annular seal element retained in an annular seal groove formed in said first annular protuberance; and said second seal means comprises a second annular seal element retained in an annular seal groove formed in said second annular protuberance.

4. The compressor assembly of claim 1 in which:

said first seal means and said second seal means each sealingly separate between said discharge pressure chamber located axially inwardly of said first and second seal means, and a suction pressure region located axially outwardly of said first and second seal means, said suction pressure regions being associated with refrigerant at suction pressure which is delivered through said suction conduit.

5. The compressor assembly of claim 1 in which:

said suction fitting comprises a housing fitting member attached to said housing sidewall, and a removable outer fitting member external of said housing, said outer fitting member being threadedly attached to said housing fitting member and said housing fitting member including said fitting bore.

6. The compressor assembly of claim 5 in which:

said suction conduit is capable of limited axial movement generally along the axes of said fitting bore and said suction inlet bore, wherein radially inward axial movement of said suction conduit is limited by said crankcase, and radially outward axial movement of said suction conduit is limited by said outer fitting member.

7. The compressor assembly of claim 5, and further comprising:

a conical screen filter disposed within said outer fitting member, including a mounting ring located at the base end of said conical filter, said mounting ring being received within a counterbore formed in the radially outer end of said outer fitting member such that said conical filter extends radially inwardly toward said housing sidewall.

8. The compressor assembly of claim 1 in which said crankcase is spaced radially inwardly from said sidewall.

9. The compressor assembly of claim 1 in which:

said first seal means comprises an annular seal element received into an annular groove formed in one of said first axial end portion and said fitting bore; and said second seal means comprises an annular seal element received into an annular groove formed in one of said second axial end portion and said suction inlet bore.

10. The compressor assembly of claim 1 wherein said conduit includes a generally cylindrical conduit bore extending axially therethrough, and further comprising:

means within said conduit bore for facilitating engagement and extraction of said suction conduit by a tool introduced through a conduit bore opening adjacent said first axial end portion and adapted to engage a step in said conduit bore along the axial length thereof, said means comprising a counterbore extending axially inwardly from a conduit bore opening adjacent said second axial end portion, thereby forming said step.

11. A compressor assembly, comprising:

a hermetically sealed housing having a sidewall;

means supported within said housing for compressing refrigerant, including a compressor mechanism having a crankcase, said crankcase having a suction cavity disposed therein and a suction inlet bore providing communication between said suction cavity and the outside of said crankcase, said suction inlet bore extending radially outwardly from said suction cavity along an axis substantially perpendicular to said sidewall;

a suction fitting mounted in said housing sidewall, said suction fitting including a housing fitting member attached to said housing sidewall and a removable outer fitting member external of said housing, said outer fitting member being threadedly attached to said housing fitting member and said housing fitting member having a fitting bore extending therethrough along an axis substantially perpendicular to said sidewall, said fitting bore and said suction inlet bore being generally aligned;

a suction conduit having a first axial end portion received within said fitting bore and a second axial end portion received within said suction inlet bore; and sealing means for sealingly engaging said first axial end portion within said fitting bore and said second axial end portion within said suction inlet bore in a manner to permit axial and angular movement of said first axial end portion and said second axial end portion relative to the axes of said fitting bore and said suction inlet bore, respectively, in response to limited movement of said compressor mechanism relative to said housing.

12. The compressor assembly of claim 11 in which:

said suction conduit is capable of limited axial movement generally along the axes of said fitting bore and said suction inlet bore, wherein radially inward axial movement of said suction conduit is limited by said crankcase, and radially outward axial movement of said suction conduit is limited by said outer fitting member.

13. The compressor assembly of claim 12 in which:

said suction conduit is generally cylindrical and has a diameter less than that of said fitting bore, whereby said suction conduit is capable of being introduced and removed through said suction fitting when said outer fitting member is removed.

14. The compressor assembly of claim 13 wherein said conduit includes a generally cylindrical conduit bore extending axially therethrough, and further comprising:

means within said conduit bore for facilitating engagement and extraction of said suction conduit by a tool introduced through a conduit bore opening adjacent said first axial end portion and adapted to engage a step in said conduit bore along the axial length thereof, said means comprising a counterbore extending axially inwardly from a conduit bore opening adjacent said second axial end portion, thereby forming said step.

15. The compressor assembly of claim 12, and further comprising:

a conical screen filter disposed within said outer fitting member, including a mounting ring located at the base end of said conical filter, said mounting ring being received within a counterbore formed in the radially outer end of said outer fitting member such that said conical filter extends radially inwardly toward said housing sidewall

16. The compressor assembly of claim 11 in which:

said sealing means comprises a first annular seal element received into an annular groove formed in one of said first axial end portion and said fitting bore, and a second annular seal element received into an annular groove formed in one of said second axial end portion and said suction inlet bore.

17. A compressor assembly, comprising:

a hermetically sealed housing having a sidewall;

means supported within said housing for compressing refrigerant, including a compressor mechanism having a crankcase, said crankcase having a suction cavity disposed therein and a suction inlet bore providing communication between said suction cavity and the outside of said crankcase, said suction inlet bore extending radially outwardly from said suction cavity along an axis substantially perpendicular to said sidewall;

a suction fitting mounted in said sidewall, said fitting including a fitting bore extending therethrough along an axis substantially perpendicular to said sidewall, said fitting bore and said suction inlet bore being generally aligned;

a generally cylindrical suction conduit having a first axial end portion and an opposite second axial end portion, said first and second axial end portions each including an annular protuberance having greater diameter than axially adjacent portions of said conduit, said first and second axial end portions being received within said fitting bore and said suction inlet bore, respectively; and seal means, cooperating between said first axial end portion and said fitting bore and between said second axial end portion and said suction inlet bore, for substantially sealing between each annular protuberance and its associated bore despite axial and angular movement of said first axial end portion and said second axial end portion relative to the axes of said fitting bore and said suction inlet bore, respectively, in response to limited movement of said compressor mechanism relative to said housing.

18. The compressor assembly of claim 17 in which:

said suction fitting comprises a housing fitting member attached to said housing sidewall, and a removable outer fitting member external of said housing, said outer fitting member being threadedly attached to said housing fitting member and said housing fitting member including said fitting bore; and said suction conduit is capable of limited axial movement generally along the axes of said fitting bore and said suction inlet bore, wherein radially inward axial movement of said suction conduit is limited by said crankcase, and radially outward axial movement of said suction conduit is limited by said outer fitting member.

19. The compressor assembly of claim 18 in which:

said suction conduit is generally cylindrical and has a diameter less than that of said fitting bore, whereby said suction conduit is capable of being introduced and removed through said suction fitting when said outer fitting member is removed.

20. A compressor assembly, comprising:

a hermetically sealed housing including a sidewall and having a discharge pressure chamber therein;

means supported within said housing for compressing refrigerant, including a compressor mechanism having a crankcase, said crankcase having a suction cavity disposed therein and a suction inlet bore providing communication between said suction cavity and the outside of said crankcase, said suction inlet bore extending radially outwardly from said suction cavity along an axis substantially perpendicular to said sidewall;

a suction fitting mounted in said sidewall, said fitting including a fitting bore extending therethrough along an axis substantially perpendicular to said sidewall, said fitting bore and said suction inlet bore being generally aligned;

a suction conduit having a first axial end portion received within said fitting bore, a second axial end portion received within said suction inlet bore, and an intermediate portion extending through said discharge pressure chamber; and first seal means disposed intermediate said first end portion and said fitting bore, and second seal means disposed intermediate said second end portion and said suction inlet bore, for sealingly engaging said conduit within said fitting bore and said suction inlet bore, respectively, said first seal means comprising a first annular protuberance on said suction conduit having greater diameter than axially adjacent portions of said suction conduit, and said second seal means comprising a second annular protuberance on said suction conduit having greater diameter than axially adjacent portions of said suction conduit, whereby said suction conduit is sealed from said discharge pressure chamber and limited movement of said compressor mechanism relative to said housing is permitted.

21. The compressor assembly of claim 20 in which:

said first seal means comprises a first annular seal element retained in an annular seal groove formed in said first annular protuberance; and said second seal means comprises a second annular seal element retained in an annular seal groove formed in said second annular protuberance.

22. A compressor assembly, comprising:

a hermetically sealed housing including a sidewall and having a discharge pressure chamber therein;

means supported within said housing for compressing refrigerant, including a compressor mechanism having a crankcase, said crankcase having a suction cavity disposed therein and a suction inlet bore providing communication between said suction cavity and the outside of said crankcase, said suction inlet bore extending radially outwardly from said suction cavity along an axis substantially perpendicular to said sidewall;

a suction fitting mounted in said sidewall, said fitting including a fitting bore extending therethrough along an axis substantially perpendicular to said sidewall, said fitting bore and said suction inlet bore being generally aligned;

a suction conduit having a first axial end portion received within said fitting bore, a second axial end portion received within said suction inlet bore, and an intermediate portion extending through said discharge pressure chamber, said conduit including a generally cylindrical conduit bore extending axially therethrough;

first seal means disposed intermediate said first end portion and said fitting bore, and second seal means disposed intermediate said second end portion and said suction inlet bore, for sealingly engaging said conduit within said fitting bore and said suction inlet bore, respectively, whereby said suction conduit is sealed from said discharge pressure chamber; and means within said conduit bore for facilitating engagement and extraction of said suction conduit by a tool introduced through a conduit bore opening adjacent said first axial end portion and adapted to engage a step in said conduit bore along the axial length thereof, said means comprising a counterbore extending axially inwardly from a conduit bore opening adjacent said second axial end portion, thereby forming said step.

* * * * *